US005253786A

United States Patent [19]

Schmidt

[11] Patent Number: 5,253,786

[45] Date of Patent: Oct. 19, 1993

[54] COSMETIC DISPENSER WITH LOCKABLE LID

[76] Inventor: Laurie H. Schmidt, P.O. Box 541237, Dallas, Tex. 75354-1237

[21] Appl. No.: 982,863

[22] Filed: Nov. 30, 1992

[51] Int. Cl.[5] ..... B67B 5/00

[52] U.S. Cl. ..... 222/153; 222/321; 70/455

[58] Field of Search ..... 222/153, 321, 383, 385; 70/455

[56] References Cited

U.S. PATENT DOCUMENTS 2,507,642 5/1950 McDonald ..... 222/153 X
3,740,981 6/1973 Patriquin ..... 70/455
4,154,072 5/1979 Flaschar ..... 70/455
4,582,227 4/1986 Kanfer ..... 222/153

FOREIGN PATENT DOCUMENTS 709839 4/1931 France ..... 222/153

*Primary Examiner*—Gregory L. Huson
*Attorney, Agent, or Firm*—John M. Cone; William L. Clayborn

[57] ABSTRACT

An improved dispenser for cosmetics has a lid that is secured to the opening of the dispenser's container by at least one lock, thus preventing access to the dispenser's contents by the public. A stopper is utilized to prevent liquids from entering the lock's keyhole.

3 Claims, 2 Drawing Sheets

COSMETIC DISPENSER WITH LOCKABLE LID

INTRODUCTION

The present invention relates to an improvement in dispensers for cosmetics, such as skin and hair care products, e.g., soap, moisturizer, shampoo, and hair conditioner. Such a dispenser is disclosed in U.S. Pat. No. 4,874,113 (Schmidt).

The lids of prior art dispensers are readily removable. Thus, when such dispensers are installed in a public place, e.g., a restroom, hotel, or a health spa, the public has only to remove the lid to have access to the cosmetics contained therein. Thus, the possibility of theft or contamination of the cosmetics arises. Therefore, an object of the present invention is to provide a means to secure the contents of such dispensers, thus preventing theft or contamination of the contents.

BRIEF SUMMARY OF THE INVENTION

According to the present invention there is provided an improved dispenser for cosmetics having a lockable lid that prevents access to the container's contents by the public. The dispenser has a hollow container with an opening for filling the container, which opening is covered by the lid. At opposed edges of the lid, there are means for securing the lid to the periphery of the container's opening, at least one of which means is releasable by means of a key. Advantageously, when the present invention is applied to modular containers such as disclosed in U.S. Pat. No. 4,874,113 (Schmidt), the lid may be adapted to cover more than one dispenser merely by extending its length an appropriate amount.

The lid is preferably comprised of a outer surface having a short, vertical lip around its entire periphery. Advantageously, the lid may be formed from a single piece of a suitable material, such as plastic.

In the preferred embodiment, there are two slots in the lip at one end of the lid. When the lid is installed, the slots engage corresponding protrusions on the outer side of the upper wall of the container, thereby securing the end of the lid 25 to the periphery of the opening 23 of the container 13.

A receptacle suitable for receiving a lock is located on the inner surface of the lid at the end opposite the end that has the slots. The lock may be one whose tang moves linearly or circularly. An appropriately located lock hole in the lid provides access to the lock's keyhole. When the lid is installed on the dispenser, the lock's tang engages a slot in upper wall of the dispenser, thereby securing the end of the lid 25 to the periphery of the opening 23 of the container 13.

There is also provided a stopper for sealing the lock hole. The stopper is constructed of a suitable flexible material, such as plastic or rubber. One end of the stopper has a plug that is adapted to fit tightly into the lock hole, thus sealing it. The other end of the stopper has an aperture that is adapted to fit between the boss of the dispenser's pump and the upper surface of the lid, thus attaching the stopper to the dispenser.

BRIEF DESCRIPTION OF THE DRAWING

A preferred embodiment of the present invention is further described, by way of example only, with reference to the accompanying drawings, in which.

DETAILED DESCRIPTION

Figure 1:
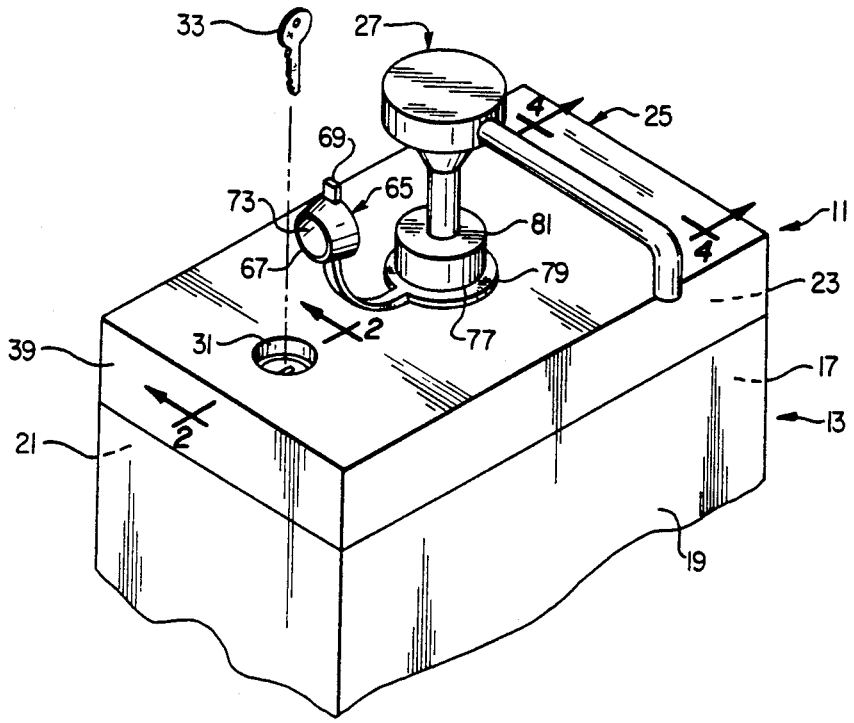
FIG. 1 is a orthographic view of the preferred embodiment of present invention installed on a dispenser having a rectangular top opening.

FIG. 1 shows a cosmetic dispenser 11 having a container 13 and a lid 25. Container 13 is rectangular in shape, having a bottom (not shown), end walls 15 and 17, and front and rear walls 19 and 21. The upper ends of walls 15, 17, 19, and 21 define a rectangular opening 23. The lid 25 is installed over the rectangular opening 23. A pump 27 extends through an aperture 29 in the lid 25 into the interior of the container 13. The pump 27 dispenses the cosmetics (not shown) contained within container 13. The lid 25 has a lock hole 31 through which key 33 is inserted into a lock (not shown).

Figure 2:
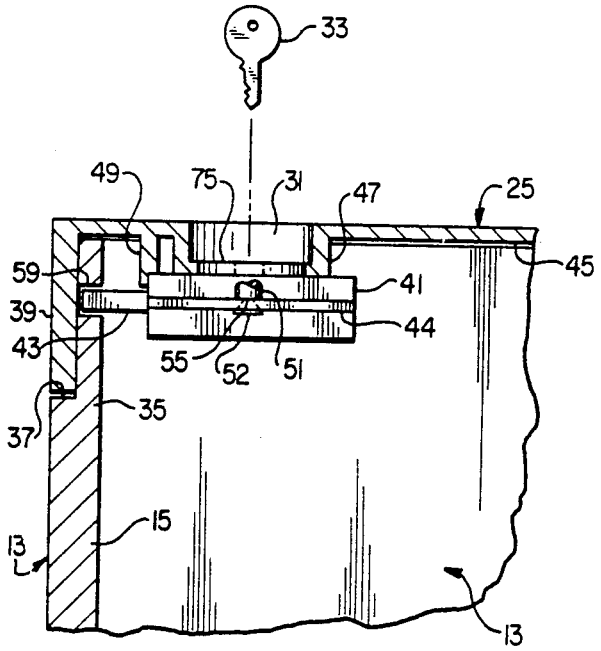
FIG. 2 is a cutaway front view of the area denoted A—A in FIG. 1.

Referring to FIG. 2, an edge 35 of end wall 15 is indented to form shoulder 37. In like manner the edges of walls 17, 19, and 21 (not shown) are indented. Thus, the shoulder 37 and the edge 35 extend around the opening 23. The lid 25 has a lip 39 that extends around its periphery. When the lid 25 is installed, the lip 39 fits against the edge 35 and the shoulder 37, thus sealing the container 13.

Figure 3:
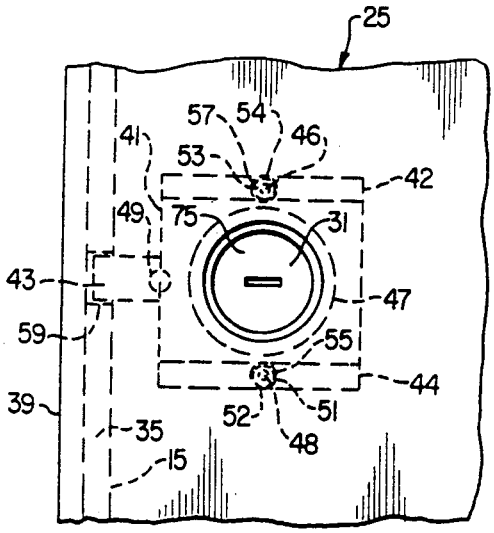
FIG. 3 is a plan view of the area shown in FIG. 2.

Referring to FIGS. 2 and 3, a lock support boss 47 extends inwardly from inner surface 45 of lid 25 and is attached thereto. Lock hole 31 passes through lock support boss 47, allowing access to the lock 41 by the key 33. Lock support pin 49 and lock attachment pins 51 and 53 also extend inwardly from the inner surface 45 of the lid 25 and are attached thereto. The lock 41 having a tang 43 is held in position against the lock support boss 47 and the lock support pin 49 by lock attachment pins 51 and 53. The lock 41 has flanges 42 and 44 in which there are holes 46 and 48. The diameter of holes 46 and 48 are less than that of lock attachment pins 51 and 53. Before installation of the lock 41, the diameter of the inner ends 52 and 54 of the lock attachment pins 51 and 53 is less than that of holes 46 and 48, thus forming shoulders 55 and 57. When the lock 41 is installed, the ends 52 and 54 are inserted through the holes 46 and 48, thus causing the lock flanges 42 and 44 to engage the shoulders 55 and 57. Simultaneously, the lock 41 engages the lock support pin 49 and the lock support boss 47. The ends 52 and 54 are then expanded, thus retaining the lock 41 in position.

After the lid 25 is installed on the container 13, the lock 41 is actuated by the key 33, causing the tang 43 to engage a slot 59 in the edge 35 of wall 15, thereby securing the end of the lid 25 to the periphery of the opening 23 of the container 13.

Figure 4:
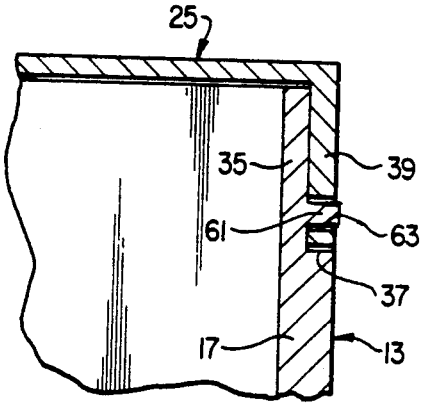
FIG. 4, is a cutaway side view of the area denoted B—B in FIG. 1.
Figure 5:
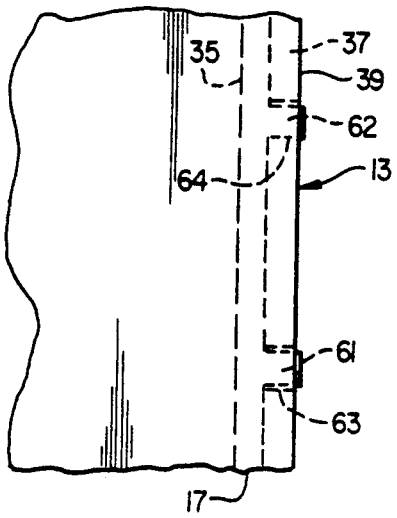
FIG. 5 is an plan view of the area shown in FIG. 4.

Referring to FIGS. 4 and 5, the end wall 17 of the container 13 is indented, forming continuations of the shoulder 37 and the edge 35. When the lid 25 is installed, protrusions 61 and 62 on the edge 35 engage slots 63 and 64 in the lip 39, thereby securing the end of the lid 25 to the periphery of the opening 23 of the container 13. The protrusions 61 and 62 and the slots 63 and 64 are equidistant from a point on the edge 35 which is opposite the slot 59 (shown in FIG. 2), resulting in the most secure retention of the lid 25 on the container 13. In addition, it will be noted that the protrusions 61 and 62 extend outwardly slightly beyond the outer surface of the lip 39. This is to prevent removal of the locked lid 25 by pressing the protrusions 61 and 62 inwardly until they disengage from the slots 63 and 64.

Figure 6:
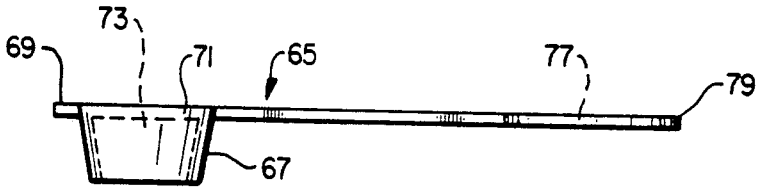
FIG. 6 is an enlarged side view of the stopper.
Figure 7:
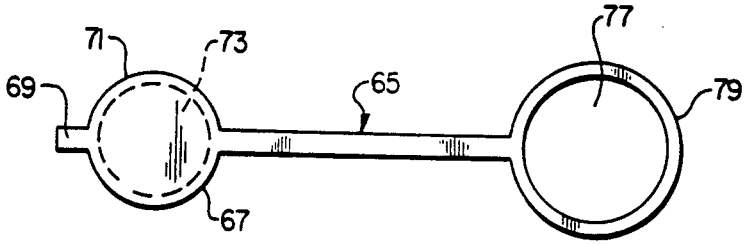
FIG. 7 is an enlarged plan view of the stopper.

FIGS. 6 and 7 show enlarged side and top views, respectively, of stopper 65. Stopper 65 is preferably formed of rubber or flexible plastic material. One end of the stopper 65 has plug 67, lifting tab 69, and plug rim 71. A void 73 provides clearance for keyhole boss 75 (See FIGS. 2 and 3) when the plug 67 is installed in the lock hole 31. When installed, the plug 67 and plug rim 71 cooperate to seal the lock hole 31. The lifting tab 69 provides a means for removing the plug 67 from the lock hole 31.

The other end of the stopper 65 contains an aperture 77. As can be seen in FIG. 1, the pump 27 is inserted through the aperture 77. Retaining loop 79 is held between pump bushing 81 and the outer surface of the lid 25, thus attaching the stopper 65 to the lid 25.

While the preferred embodiment of the invention has been shown and described, it will be apparent to those skilled in this art that various modifications may be made to this embodiment without departing from the spirit of the present invention. For that reason, the scope of the invention is set forth in the following claims:

I claim:

1. A dispenser for liquids, such as cosmetics, comprising:

a hollow container having an opening for filling the container, said opening having a periphery;

a lid having first and second opposed edge portions and an inner surface;

means for securing the lid at its opposed edge portions, at least one of said securing means being a lock that is releasable by means of a key;

said lock having a moveable tang and being attached to the inner surface of the lid adjacent to the second edge portion thereof;

an aperture in the lid through which access to the lock may be had to insert the key therein;

receiving means in the periphery of the container opening, said receiving means being adapted to engage the lock's tang, thereby securing the second opposed edge portion of the lid to the container opening;

a plug having first and second ends;

the first end being adapted to be inserted in said aperture, thereby sealing the aperture and thus protecting the lock; and the second end having means to attach the plug to the lid.

2. A dispenser as claimed in claim 1 wherein:

the dispenser has a pump that has a boss;

the lid has an outer surface and an aperture through which a portion of the pump is inserted into the container; and the means for attaching the second end of the plug to the lid comprises a ring that has an aperture through which the portion of the pump that is inserted into the container passes, said ring being positioned between the boss and the outer surface of the lid and held in position thereby.

3. A dispenser as claimed in claim 1 wherein:

the periphery of the container opening has an outer surface;

the lid has a main plane and a peripheral lip extending at right angles thereto; and the means for securing the first opposed edge portion of the lid to the periphery of the container opening comprises at least one protrusion which faces outwardly from the outer surface of the opening periphery, said protrusion being adapted to engage a receiving means in the lip of the lid.

* * * * *